US007056010B2

(12) United States Patent
Davies

(10) Patent No.: US 7,056,010 B2
(45) Date of Patent: Jun. 6, 2006

(54) BLENDER FOR MIXING PARTICULATE SOLID MATERIALS INCLUDING AN INTERNAL BAFFLE

(75) Inventor: Clive Eric Davies, Waikanae (NZ)

(73) Assignee: Industrial Research Limited, (NZ)

( * ) Notice: Subject to any disclaimer, the term of this patent is extended or adjusted under 35 U.S.C. 154(b) by 42 days.

(21) Appl. No.: 10/258,038

(22) PCT Filed: Apr. 20, 2001

(86) PCT No.: PCT/NZ01/00066

§ 371 (c)(1),
(2), (4) Date: Mar. 13, 2003

(87) PCT Pub. No.: WO01/80984

PCT Pub. Date: Nov. 1, 2001

(65) Prior Publication Data

US 2003/0161213 A1 Aug. 28, 2003

(30) Foreign Application Priority Data

Apr. 23, 2000 (NZ) ..... 502032

(51) Int. Cl.
*B01F 9/06* (2006.01)

(52) U.S. Cl. ..... 366/228

(58) Field of Classification Search ..... 366/56–58, 366/225–226, 228, 220, 229–231, 341
See application file for complete search history.

(56) References Cited

U.S. PATENT DOCUMENTS 35,588 A * 6/1862 Copeland et al.
64,210 A * 4/1867 Emerson
99,235 A * 1/1870 Rees
230,405 A * 7/1880 Copeland
2,138,550 A * 11/1938 MacLellan
2,288,440 A * 6/1942 Evans
2,665,890 A * 1/1954 Hall
3,095,185 A * 6/1963 Smalley
3,341,183 A * 9/1967 Bergstrom et al.
4,077,613 A * 3/1978 Wilson
5,005,983 A 4/1991 Draffen et al.
5,651,613 A 7/1997 Mays et al.
6,626,975 B1 9/2003 Gries et al.
2003/0161213 A1* 8/2003 Davies ..... 366/228

FOREIGN PATENT DOCUMENTS

EP 783920 A1 * 7/1997
GB 1537072 12/1978

(Continued)

OTHER PUBLICATIONS

Osama S. Sudah et al., "Quantitative characterization of mixing of free-flowing granular material in tote (bin)-blenders," Powder Tech., 126 (2002), pp. 191-200.

(Continued)

*Primary Examiner*—Charles E. Cooley
(74) *Attorney, Agent, or Firm*—Dann, Dorfman, Herrell and Skillman, P.C.

(57) ABSTRACT

A bin blender for mixing particulate solid materials, comprises a closable bin for containing the materials and having a non-circular cross-sectional shape, mounted for rotation of the bin about an axis extending across the interior of the bin, and an internal baffle extending within the bin at an angle of less than about 45° to the axis of rotation of the bin.

17 Claims, 9 Drawing Sheets

FOREIGN PATENT DOCUMENTS

| | | | |
|---|---|---|---|
| GB | 2159427 | | 12/1985 |
| GB | 2254797 | | 10/1992 |
| JP | 60-202725 | * | 10/1985 |
| WO | WO 8002808 | | 12/1980 |

OTHER PUBLICATIONS

Arthur W. Chester et al., "Mixing dynamics in catalyst impregnation in double-cone blenders," Powder Tech., 102 (1999), pp. 85-95.

K.J. Sethuraman et al., "Studies on Solids Mixing in a Double-Cone Blender," Powder Tech., 4 (1971/72), pp. 115-118.

T.K. Ramanujam et al., "Studues on the Mixing of Solids in a Double-Cone Bender," Indian Inst. of Tech., 7(7) (1969), pp. 218-220.

Osama S. Sudah et al., "Quantitative Characterization of Mixing Free-Flowing Granular Material in Tote (Bin)-Blenders".

International Search Report (International Application No. PCT/NZ99/00220), May 24, 2000.

* cited by examiner

BLENDER FOR MIXING PARTICULATE SOLID MATERIALS INCLUDING AN INTERNAL BAFFLE

FIELD OF INVENTION

The invention relates to bin blenders for mixing particulate solid materials.

BACKGROUND

The bin blender, or tote blender as it is also called, is one of a family of devices for batch mixing particulate solids, in which mixing is promoted by rotating a vessel containing the solids about a fixed axis. Bin blenders usually have a square cross-section, constant in the upper part of the bin, and reducing uniformly to a discharge point at the lower end. The axis of rotation is fixed at an angle of typically about 15 degrees to a diagonal drawn between opposite corners of a cross-section through the bin. Bin blenders are an attractive option for many processes, because the blending vessel can also be used for storing and transporting the particles, while keeping them in a controlled environment.

The purpose of a blender is to produce a uniform mixture of two or more different components, which are placed in the blender in fixed proportions to each other, so that, after the blender has been operated, samples taken from the mixture contain the different components in proportions the same as or similar to the proportions of the components placed in the blender. In many industrial applications, the mixture made in the blender is removed from the blender, and then divided into batches. If the components in the blender are not intimately and uniformly mixed, then the proportions of the components in the different batches can differ from batch to batch. Also, the proportions of the components in a batch can differ from the proportions of the components placed in the blender. For most mixing operations, if the proportions of the components in samples taken from the mixture are sufficiently close to the proportions of the components placed in the blender, then the mixing operation is thought of as satisfactory. The extent to which the proportions of the components must be similar to the proportions of the components placed in the blender, or the limits of the composition of the mixture are often given in specifications relating to the particular mixture and mixing operation.

SUMMARY OF INVENTION

In broad terms in one aspect the invention comprises a bin blender for mixing particulate solid materials comprising a closable bin for containing the materials and having a non-circular cross-sectional shape, the bin being rotatably mounted for rotation of the bin about an axis extending across the interior of the bin, and an internal baffle within the bin having a height dimension, and a depth dimension of the baffle across the interior of the bin and generally towards or through a center region of the bin.

Preferably the axis of rotation of the bin extends across the interior of the bin at an angle of less than about 45° to a diagonal across the bin between two opposite corners of the bin. Preferably the axis of rotation of the bin extends across the interior of the bin at an acute angle of less than about 30° to the diagonal across the bin.

Preferably the baffle member extends at an angle of less than about 45° to the axis of rotation of the bin. Preferably the baffle member extends at an angle of less than about 30° to the axis of rotation of the bin. Preferably the baffle extends at an acute angle to the axis of rotation of the bin.

Preferably the baffle extends in a depth dimension of the baffle from at or near one corner or side of the bin part way across the interior of the bin towards another corner or side of the bin. Preferably the depth dimension of the baffle member across the interior of the bin is between about one third and two thirds of the dimension across the interior of the bin in the plane of the baffle member. Preferably the height dimension of the baffle member is less than the full height of the interior of the bin but is at least half of the full height of a substantially constant cross-section part of the interior of the bin.

It has been found that it can be difficult to operate a bin blender in a way that produces a satisfactory mixture. More particularly, it can be necessary to rotate a bin blender a very large number of times to achieve good mixing. This can cause breakage of the materials being blended, and is also time consuming. With the blender of the invention the number of times that a bin blender must be rotated so that the proportions of the components in samples taken from the mixture, are sufficiently close to the proportions of the components placed in the blender, that the composition of the mixture is within specification and the mixing operation is considered to be satisfactory, is reduced.

BRIEF DESCRIPTION OF THE DRAWINGS

The invention is further described with reference to the accompanying drawings, by way of example and without intending to be limiting. In the drawings.

DETAILED DESCRIPTION OF PREFERRED FORM

Figure 1:
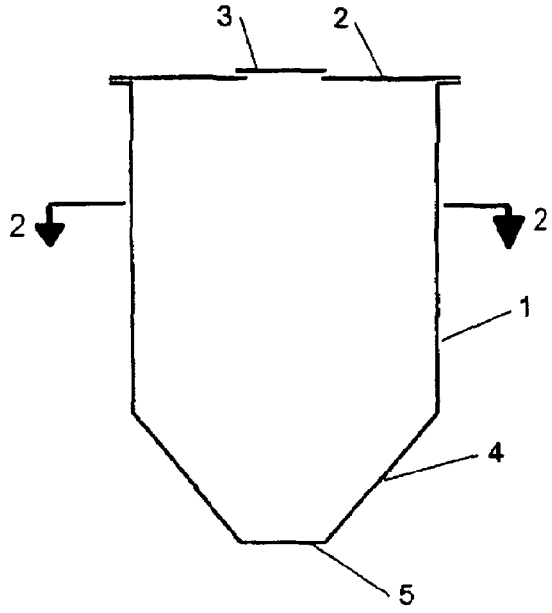
FIGURE 1 PRIOR ART
FIG. 1 is a longitudinal cross-sectional view through the bin of a conventional bin blender.

Referring to FIG. 1 a conventional bin blender comprises a bin typically having a square or rectangular shape in transverse cross-section, formed by side walls 1. The bin has a roof 2 including a door 3 for loading particulate materials to be blended into the bin, and a lower section 4 which has an inverted pyramidal shape and tapers towards an outlet 5 from which the blended materials may be dispensed in use in a manufacturing process or for packaging or similar. The bin may alternatively have a circular or any other shape in cross-section with a conical lower section, and need not be of a constant cross-sectional shape between the bin side walls.

Figure 2:
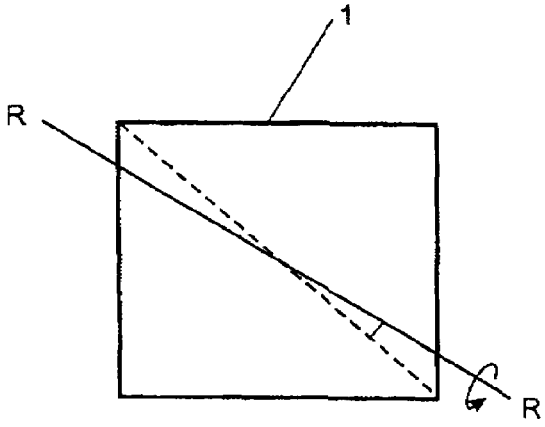
FIGURE 2 PRIOR ART
FIG. 2 is a transverse cross-section view of the bin of FIG. 1 along line 2—2 of FIG. 1.

In use dry particulate solids are loaded into the interior of the bin through door 3, and the bin is then closed and rotated through 360 degrees a number of times about an axis extending asymmetrically (or symmetrically) across the interior of the bin, such as asymmetric axis R—R indicated in FIG. 2 until the contents are considered to be sufficiently blended. The bin is then brought back to its starting position and the contents are emptied into a product stream in a manufacturing process or to a packaging stage if the blended materials form an end product such as a particulate laundry detergent for example. Typically a bin blending system comprises a number of individual bins as described forming a bin chain, which are conveyed from a bulk supply of the two or more materials to be blended to an input point for the materials in a manufacturing process or packaging stage, so that the bin chain provides a continuous supply of the blended particulate materials.

Referring to FIGS. 3 to 8, in accordance with the invention the bin includes an internal baffle 6 of a particular form. The baffle may be formed by a planar member like a plate.

Figure 3:
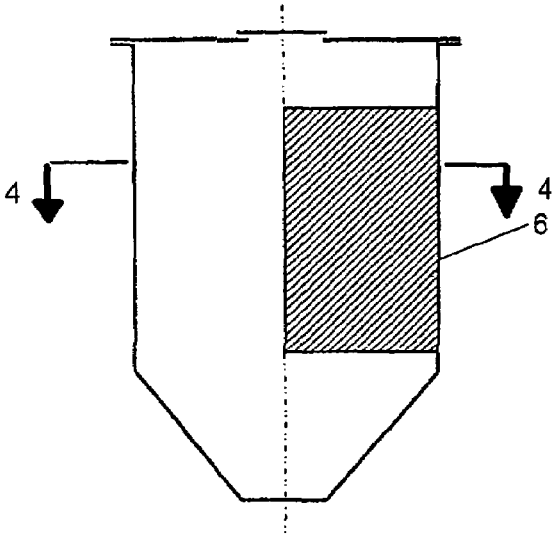
FIG. 3 is a longitudinal cross-section view similar to FIG. 1 through a bin incorporating one form of internal baffle in accordance with the invention.
Figure 4:
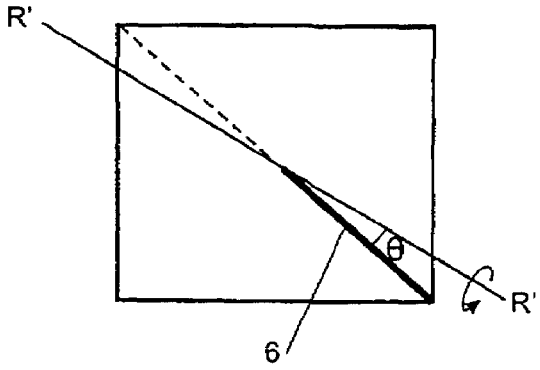
FIG. 4 is a transverse cross-section view along line 4—4 of FIG. 3, similar to FIG. 2, of the preferred form bin of the invention of FIG. 3.

In the form of FIGS. 3 and 4 the baffle 6 extends within the bin generally in line with the longitudinal axis of the bin and for over half the height of the bin, and from a corner of the bin to which the baffle is attached at one longitudinal edge, to about the center of the bin as shown. In this form the opposite longitudinal edge of the baffle is generally in alignment with a central axis of the bin. The depth of the baffle across the bin is approximately half the diagonal diameter of the interior of the bin between opposite corners of the bin. The baffle is less than the full height of the interior of the bin, but more than half of the height of the interior of the bin.

In the preferred form shown in the drawings, the bin has a square transverse cross-section as shown, and the axis of rotation R'—R' shown in FIG. 4 about which the bin is rotated during blending extends at an acute angle to a diagonal axis between opposed corners of the square (or rectangular) bin, and the baffle 6 extends in a plane between diagonally opposite corners of the bin as shown. The axis of rotation of the bin may be co-incident with such a diagonal axis but preferably extends at an acute angle θ between the baffle and the angle of rotation of up to about 45°, further preferably at an acute angle of less than about 30°.

Figure 5:
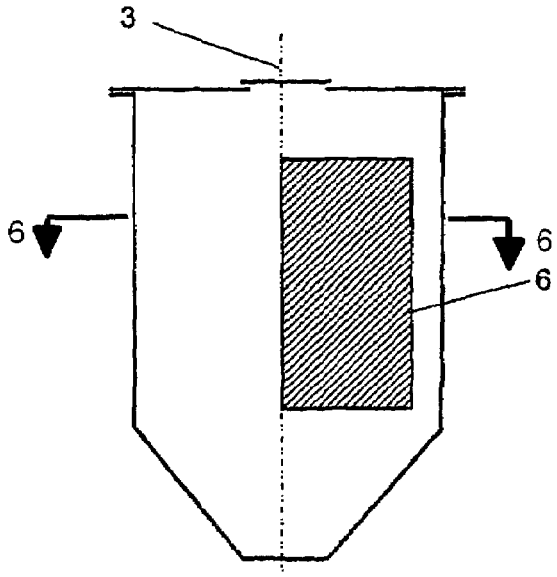
FIG. 5 is a longitudinal cross-section view similar to FIG. 1 through a bin incorporating another form of internal baffle in accordance with the invention.
Figure 6:
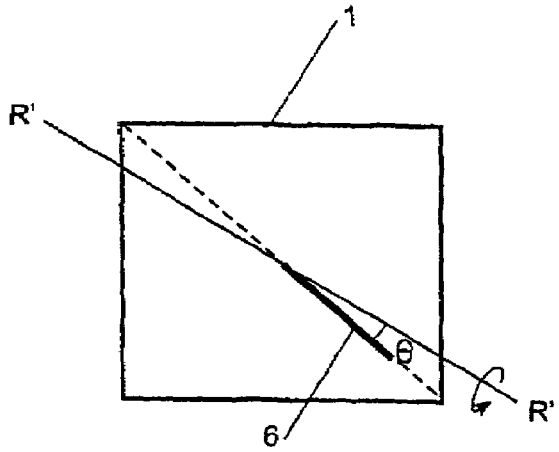
FIG. 6 is a transverse cross-section view along line 6—6 of FIG. 5, similar to FIG. 2 of the preferred form bin of the invention of FIG. 5.

In the form of FIGS. 5 and 6 the baffle 6 extends from near one corner of the bin but the longitudinal edge of baffle adjacent the corner is spaced from the corner of the bin. In other respects the baffle is the same as in FIGS. 3 and 4. It may be preferred that the baffle not extend into a corner of the bin since this makes it harder to clean the interior of the bin when not in use.

Figure 7:
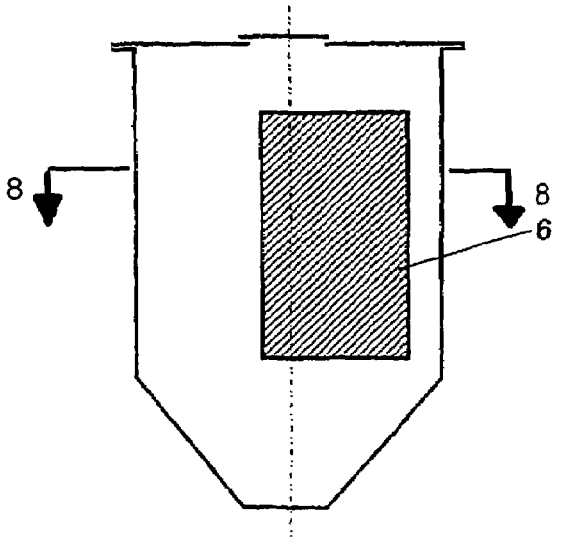
FIG. 7 is a longitudinal cross-section view similar to FIG. 1 through a bin incorporating a further form of internal baffle in accordance with the invention.
Figure 8:
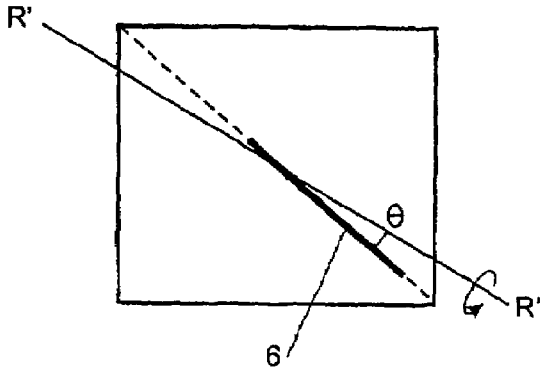
FIG. 8 is a transverse cross-section view along line 8—8 of FIG. 7, similar to FIG. 2, of the preferred form bin of the invention of FIG. 7.

In the form of FIGS. 7 and 8 the baffle extends from near a corner of the bin across the bin past the center of the bin, but is still asymmetrical within the interior of the bin when viewed in section across the bin and the depth dimension of the baffle is preferably not more than one half of the diameter of the bin.

Figure 9:
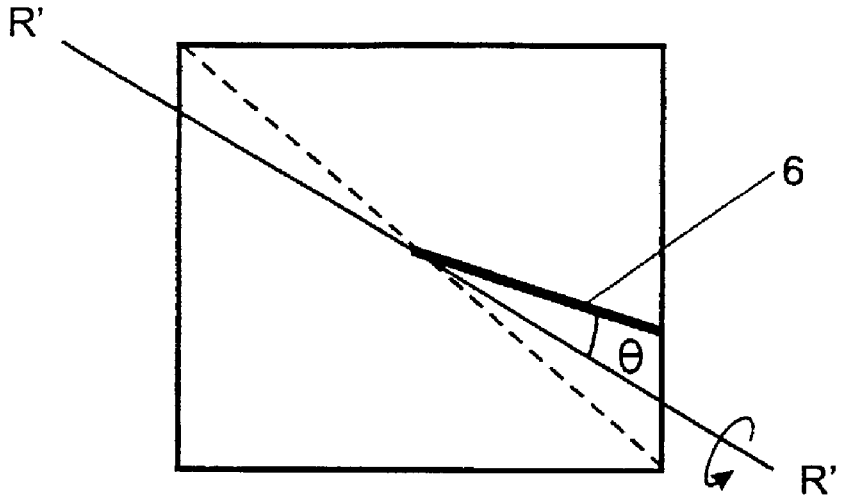
FIG. 9 is a transverse cross-section view similar to FIG. 2, of the preferred form bin of the invention of FIG. 3.

It is not essential that the baffle extend from a corner of the bin and FIG. 9 shows in cross-section another baffle which extends asymmetrically across the interior of the bin from a side wall of the bin.

Figure 10:
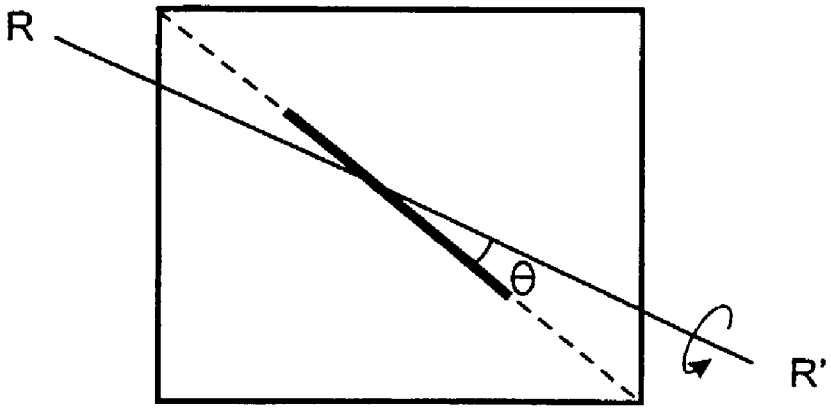
FIG. 10 is a transverse cross-section view similar to FIG. 2 of another preferred form of bin of the invention.

FIG. 10 shows another form of bin blender of the invention in which a baffle extends across the interior of the bin through a central axis of the bin spaced from the corners of the bin at either the longitudinal edge of the baffle. The central longitudinal axis of the baffle member generally coincides with a central axis of the bin.

Figure 11:
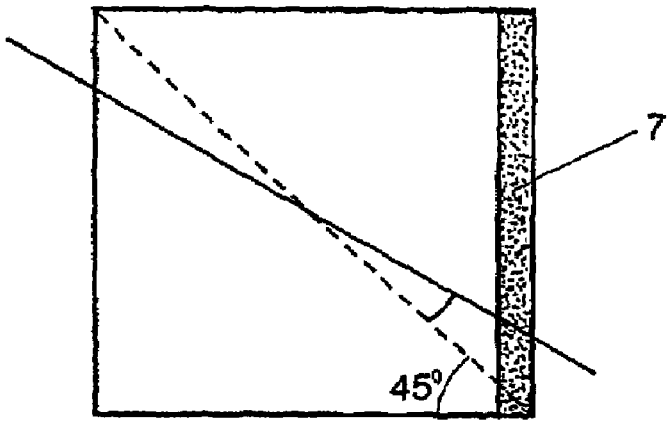
FIGS. 11 and 12 are transverse and longitudinal cross-sectional views which are referred to further in the experimental work described subsequently, FIG. 11 being a transverse cross-sectional view along line 11—11 of FIG. 12.
Figure 12:
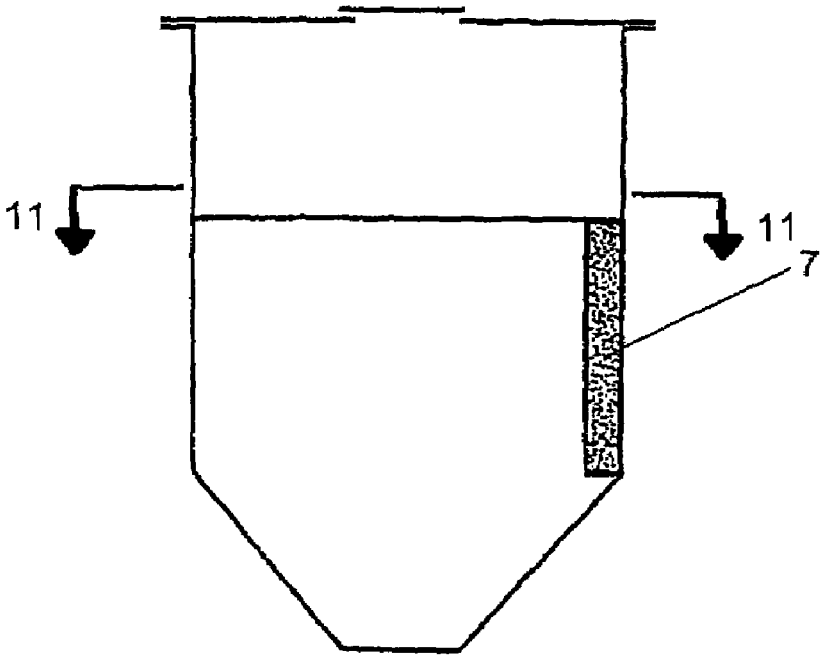

Experimental work has shown that in a bin blender incorporating a baffle of the invention, the degree of mixing or blending achieved with a set number of rotations of the bin is very substantially and surprisingly improved, or that to achieve a desired degree of blending or mixing the number of rotations required may be reduced substantially, giving a commercially significant reduction in blending time required. Experiments measuring the extent of mixing were carried out with a white powder. Some of the particles in the powder were stained with a black dye. The stained particles, which were black, could easily be seen against a background of white particles. White powder was placed in the blender so that about 70% of the volume of the blender was filled with particles, and a small quantity of the stained particles was placed in a narrow region 7 of the blender as shown in FIG. 11; a plan view of the narrow band of particles is shown in FIG. 12. Care was taken to ensure that when the black particles were placed in the blender, they were only placed in the narrow region 7.

Figure 13:
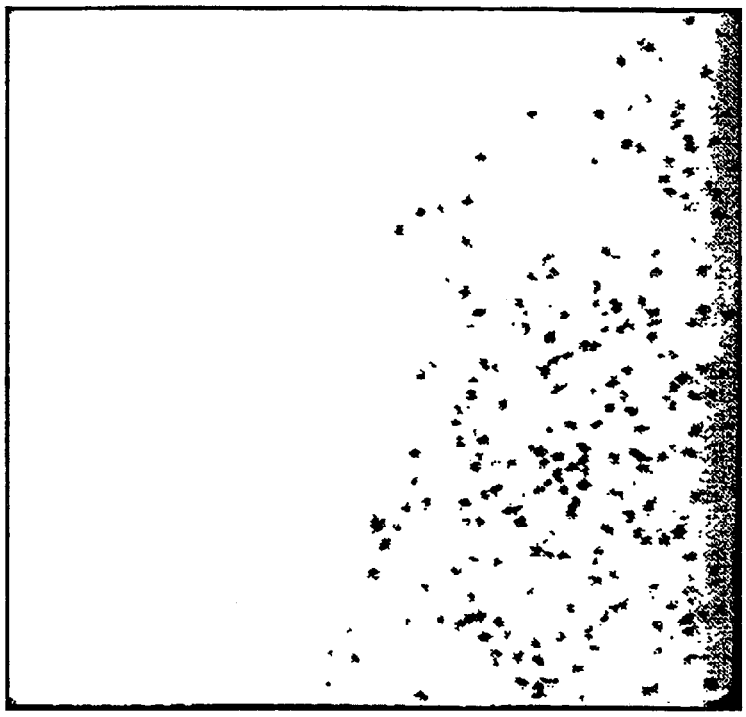
FIGS. 13 and 14 are reproductions of photographs referred to further in the experimental work described subsequently illustrating the degree of mixing achieved in a conventional blender and a blender of the invention.

This was first of all done with the blender without an internal baffle. The blender was then rotated 20 times, at a rate of 50 revolutions per minute. The number of rotations and the speed of rotation were chosen for the purposes of this experiment, and are for example only. The powder was then removed from the blender by using a suction device to suck the powder out. The powder was sucked out a small amount at a time, and in a way that the surface of the powder exposed in the blender was flat and could easily be inspected. It could be seen that there were black particles outside the narrow region 7 where they had been placed before the blender was rotated. Photographs were taken of the surface of the powder in the blender with a digital camera, and FIG. 13 is reproduced from a typical photograph. The black dots in the photograph are the black stained particles of powder. It is clear that the black particles have spread across the blender, but have not spread to all parts of the cross section of the blender.

Figure 14:
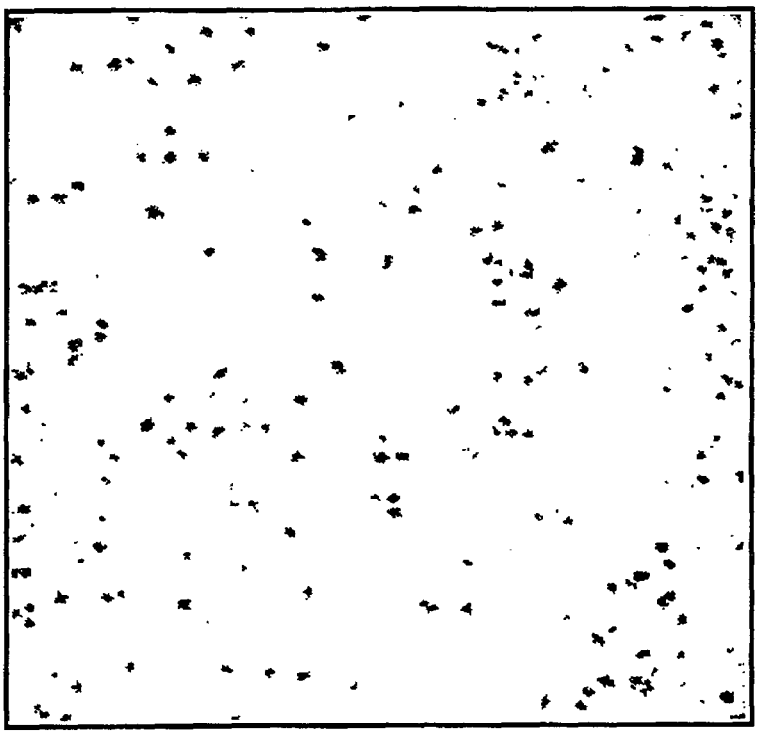

In a second experiment, the blender was fitted with a baffle as shown in FIGS. 3 and 4. White powder and a small quantity of black particles were placed in the blender according to the method of the experiments for measuring the extent of mixing. The blender was then rotated 20 times, at a rate of 50 revolutions per minute. The powder was then removed from the blender by using a suction device to suck the powder out. The powder was sucked out a small amount at a time, and in a way that the surface of the powder exposed in the blender was flat and could easily be inspected. As in the previous experiment, photographs were taken of the surface of the powder. FIG. 14 is a reproduction of a typical photograph for the experiment with the blender having a baffle according to this invention. It is clear that there are black dots spread out across the whole cross-section of the blender.

The black particles move from the narrow region, 7, because of the effects of the mixing processes in the blender, and in a mixture that is well mixed it is to be expected that the black particles will be spread out in the mixture in a uniform manner. Referring to FIG. 13, which is for a blender which was operated in accordance with this invention and to FIG. 12 which is for a blender which is not operated in accordance with this invention, it is clear that this invention improves the mixing to a very significant extent.

Figure 15:
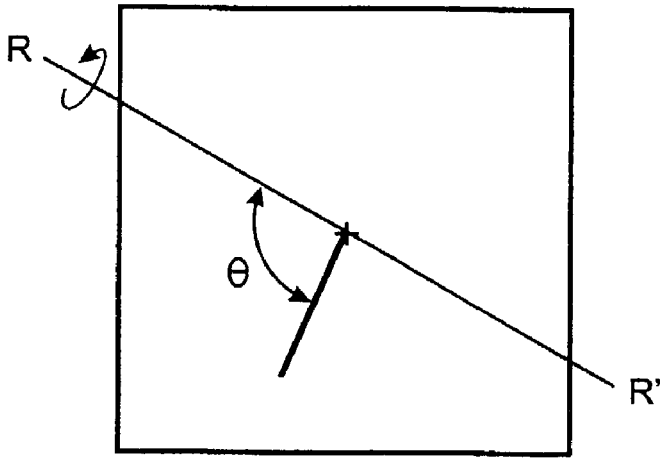
FIGS. 15 and 17 are transverse cross-sectional views of bin blenders incorporating a baffle outside of the scope of the invention, and in accordance with the invention respectively.
Figure 16:
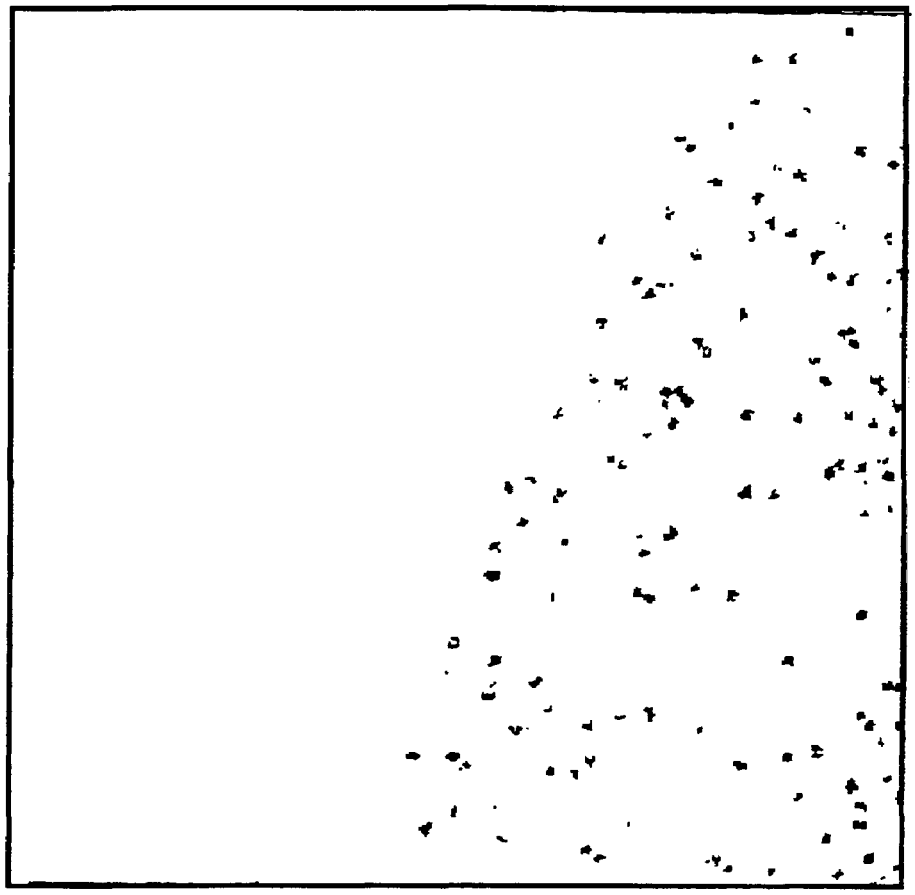
FIGS. 16 and 18 are reproductions of photographs referred to further in the experimental work described subsequently illustrating the degree of mixing achieved in the bin blenders of FIGS. 15 and 17.

FIG. 16 is a reproduction from photographs taken of the surface of the powder in a blender after placement as described above of white powder and black tracer particles in a blender with a baffle portion shown in FIG. 15, in which blender a baffle was positioned at an angle of 97.5% to the axis of rotation of the bin (outside of the scope of the present invention). It is apparent from FIG. 16 that this baffle position achieved poor mixing.

Figure 17:
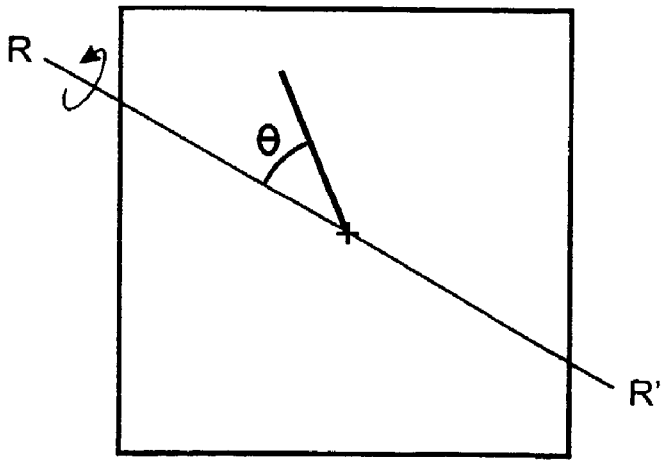
Figure 18:
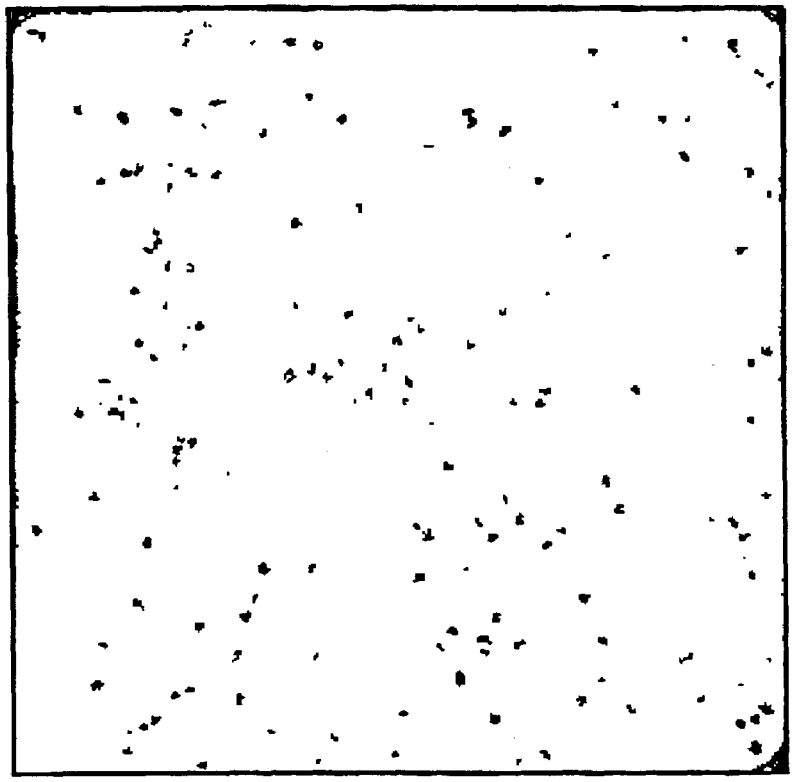

FIG. 18 shows the result of a similar experiment in which the baffle was positioned as shown in FIG. 17, at an angle of 37.5% to the axis of rotation of the bin blender, and it is clear from FIG. 18 that the black particles have spread across the blender and that good mixing has been achieved.

The foregoing describes the invention including a preferred form thereof. Alterations and modifications as will be obvious to those skilled in the art are intended to be incorporated within the scope hereof as defined in the accompanying claims.

The invention claimed is:

1. A bin blender for mixing particulate solid materials, comprising a closable bin for containing the material and having height and depth dimensions, a non-circular cross-sectional shape, and an interior, the bin being rotatably mounted for rotation of the bin about an axis extending across the interior of the bin, the bin comprising an internal baffle within the bin, the baffle being directly attached to, or attached to but spaced from, an interior surface of a side wall of the bin along a longitudinal edge of the baffle, the baffle having a height dimension of at least half the height of the interior of the bin but less than the full height of the interior of the bin, which baffle extends in a depth dimension of the baffle from at or near one corner or side of the bin part way across the interior of the bin towards another corner or side of the bin either to a center region of the bin so that an opposite longitudinal edge of the baffle generally coincides with said center region of the bin, or through a center region of the bin so that an opposite longitudinal edge of the baffle is positioned on an opposite side of the interior of the bin from said one corner or side of the bin.

2. A bin blender according to claim 1 wherein the bin has four corners and the axis of rotation of the bin extends across the interior of the bin at an angle of less than about 45° to a diagonal across the bin between two opposite corners of the bin.

3. A bin blender according to claim 2 wherein the axis of rotation of the bin extends across the interior of the bin at an acute angle of less than about 30° to the diagonal across the bin.

4. A bin blender according to claim 1 or claim 2 wherein the baffle member extends at an angle of less than about 45° to the axis of rotation of the bin.

5. A bin blender according to claim 1 wherein the baffle member extends at an angle of less than about 30° to the axis of rotation of the bin.

6. A bin blender according to claim 1 wherein the baffle extends at an acute angle to the axis of rotation of the bin.

7. A bin blender according to claim 1 wherein the depth dimension of the baffle member across the interior of the bin is between about one third and two thirds of the dimension across the interior of the bin in the plane of the baffle member.

8. A bin blender according to claim 1 where the baffle is a generally planar baffle member.

9. A bin blender according to claim 1 wherein the bin has a generally square or rectangular cross-sectional shape.

10. A bin blender according to claim 1 where a lower part of the bin has an inverted generally pyramidal or conical shape with an outlet from the bin at its lower end.

11. A bin blender for mixing particulate solid materials, comprising a closable bin for containing the material and having a non-circular cross-sectional shape, the bin being rotatably mounted for rotation of the bin about an axis extending across the interior of the bin, and an internal baffle within the bin having a height dimension, and a depth dimension of the baffle across the interior of the bin generally towards or through a centre region of the bin and wherein a central longitudinal axis of the baffle member generally coincides with a central axis of the bin.

12. A bin blender according to claim 11 wherein the bin has four corners and the axis of rotation of the bin extends across the interior of the bin at an angle of less than about 45° to a diagonal across the bin between two opposite corners of the bin.

13. A bin blender according to claim 12 wherein the axis of rotation of the bin extends across the interior of the bin at an acute angle of less than about 30° to the diagonal across the bin.

14. A bin blender according to claim 11 wherein the baffle member extends at an angle of less than about 45° to the axis of rotation of the bin.

15. A bin blender according to claim 11 wherein the baffle member extends at an angle of less than about 30° to the axis of rotation of the bin.

16. A bin blender according to claim 11 wherein the baffle extends at an acute angle to the axis of rotation of the bin.

17. A bin blender according to claim 11 wherein one longitudinal edge of the baffle member is spaced from at or near one corner of the bin.

* * * * *